United States Patent [19]

Broaddus

[11] Patent Number: 4,836,763

[45] Date of Patent: Jun. 6, 1989

[54] SEVEN HOLE SPINNERET

[75] Inventor: Clarke R. Broaddus, Greenville, N.C.

[73] Assignee: E. I. DuPont De Nemours and Company, Wilmington, Del.

[21] Appl. No.: 225,807

[22] Filed: Jul. 29, 1988

[51] Int. Cl.[4] ..... B29G 47/20

[52] U.S. Cl. ..... 425/131.5; 264/173; 264/177.14; 264/209.1; 425/133.1; 425/461

[58] Field of Search ..... 264/177.13, 174; 425/382.2; 428/398

[56] References Cited

U.S. PATENT DOCUMENTS

| | | | |
|---|---|---|---|
| 3,357,051 | 12/1967 | Zolotarevsky | 425/464 |
| 3,405,424 | 10/1968 | Imobersteg et al. | 425/464 |
| 3,525,282 | 8/1970 | Hawkins | 83/695 |
| 3,745,061 | 7/1973 | Champaneria et al. | 428/398 |
| 3,834,251 | 9/1974 | Hawkins | 76/107 S |
| 4,020,229 | 4/1977 | Cox, Jr. | 428/372 |
| 4,407,889 | 10/1983 | Gintis et al. | 428/398 |
| 4,648,830 | 3/1987 | Peterson et al. | 425/464 |
| 4,743,189 | 5/1988 | Samuelson | 425/131.5 |

FOREIGN PATENT DOCUMENTS

| | | | |
|---|---|---|---|
| 2803136 | 7/1979 | Fed. Rep. of Germany | 264/177.14 |
| 3011118 | 1/1981 | Fed. Rep. of Germany . | |
| 23829 | 9/1955 | German Democratic Rep. . | |
| 47-36202 | 9/1972 | Japan | 425/131.5 |
| 52-33661 | 8/1977 | Japan | 264/173 |
| 55-148248 | 11/1980 | Japan | 264/171 |
| 60-7045 | 2/1985 | Japan . | |
| 62-150000 | 7/1987 | Japan . | |
| 62-206008 | 9/1987 | Japan . | |
| 62-206009 | 9/1987 | Japan . | |
| 6147807 | 3/1988 | Japan . | |
| 2045153 | 10/1980 | United Kingdom | 264/177.14 |

OTHER PUBLICATIONS

Textile Mouth., Oct. 1982, pp. 22–23.

Chart of Irregular Shaped Holes, Kasen Nozzle Mfg. Co., Ltd., Osaka, Japan.

*Primary Examiner*—Jay H. Woo

*Assistant Examiner*—Khanh P. Nguyen

[57] ABSTRACT

Segmented spinning capillaries for post-coalescent spinning provide the capability to spin round cross-section filaments with round continuous voids along the length of the filaments by adding an inner arcuate slot at the base of each spoke of each slot segment.

3 Claims, 1 Drawing Sheet

SEVEN HOLE SPINNERET

BACKGROUND OF THE INVENTION

This invention relates to spinnerets and, more particularly, it relates to spinnerets for spinning substantially round filaments having a plurality of longitudinal voids along their lengths.

Copending U.S. application Ser. No. 120,438 filed Nov. 13, 1987, concerns a new polyester fiber fill containing multiple continuous voids along the length of the filaments and, in particular, describes a polyester fiberfill of essentially round cross-section with at least seven continuous voids of essentially round cross-section along the length of the filaments, one such void being located centrally, while the remaining voids are of essentially the same size as each other and are esentially equally spaced around the central void and from the periphery of the filament.

SUMMARY OF THE INVENTION

A spinneret for the production of such filaments comprises a plate having upper and lower surfaces connected by a capillary. The capillary is formed of a plurality of segments. Each segment is comprised of an outer and an inner arcuate slot joined by a rectangularly shaped slot that places the arcuate slots in communication with each other. The segments are equally spaced a distance from the center of the capillary and are equally spaced angularly about the center of the capillary. In a preferred embodiment, the slot joining the inner and outer arcuate slots joins them at a central location and has a width that is greater than the width of the inner arcuate slot, and the outer arcuate slot has a width greater than the width of the slot joining the inner and outer arcuate slots. The spinneret is a one piece spinneret which does not suffer the disadvantages of multipart spinnerets which are adapted to form hollow fibers.

DETAIIED DESCRIPTION OF THE PREFERRED EMBODIMENT

Figure 1:
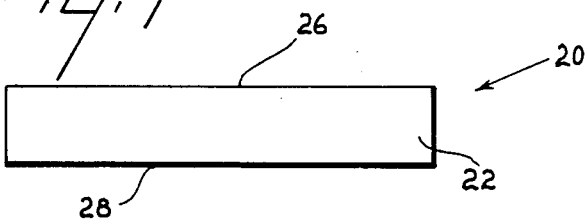
FIGS. 1 and 2 are side elevation and lower surface views, respectively, of the spinneret of this invention.
Figure 2:
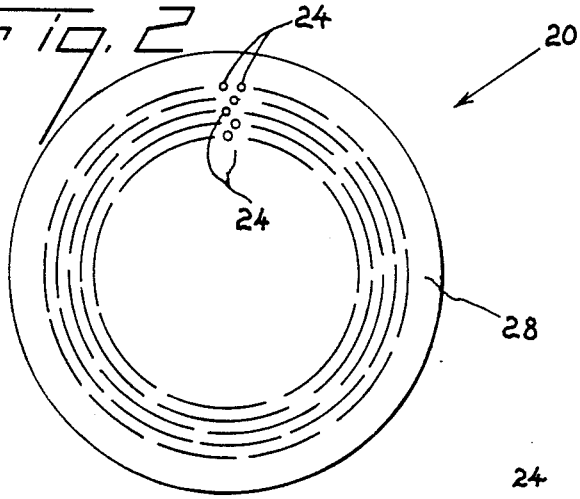
Figure 3:
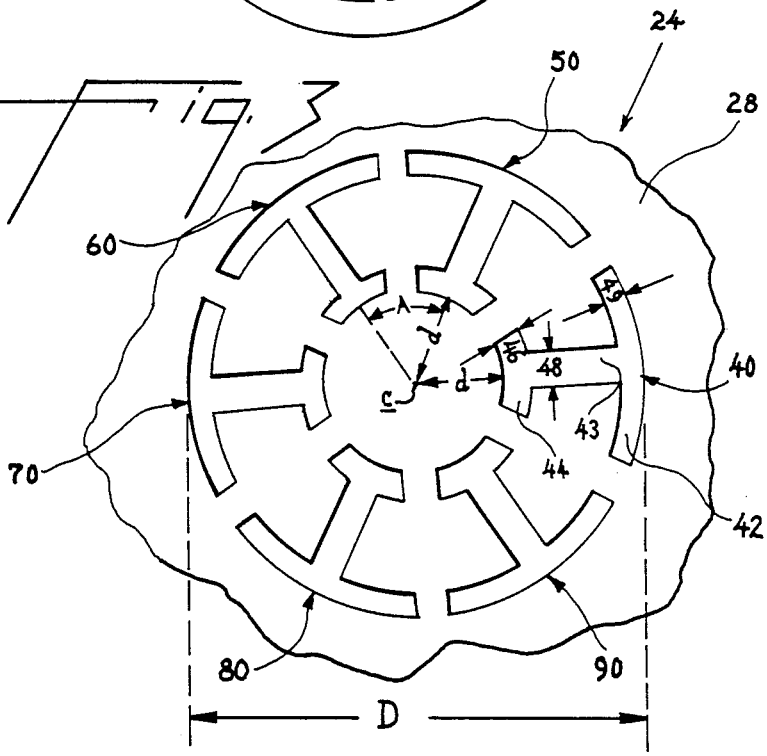
FIG. 3 is an enlarged view of a spinneret capillary viewed from the lower surface of the spinneret of FIGS. 1 and 2.

Referring now to FIGS. 1–3, spinneret 20 is adapted to be mounted in a filter pack (not shown) for supplying polymer to be spun into filaments. The spinneret 20 is formed from a plate 22 and is provided with a plurality of capillaries 24 connecting its upper and lower surfaces 26, 28, respectively. The capillary 24 is formed of six individual segments designated 40, 50, 60, 70, 80 and 90. Each segment is spaced an equal distance d from the center c of the capillary and also the segments are equispaced from each other angularly about the center c at an angle A. Each of the segments are the same dimensions and for purposes of description segment 40 will be described in detail. More particularly, as best shown in FIG. 3, segment 40 includes an outer arcuate slot 42 connected to an inner arcuate slot 44 by an elongated slot 43 located between and in communication with the outer and inner arcuate slots 42, 44, respectively.

In the preferred configuration of capillary 24 the width 48 of slot 43 is greater than the width 46 of inner arcuate slot 44 and the width 49 of the outer arcuate slot 42 is greater than the width 48 of arm 43.

A typical capillary has an outside diameter D of 0.062", a length d of 0.012", and an angle A of about 60°. The relationship of the widths 46, 48 and 49 is as follows: width 48 is about 1.1 times width 46 and width 49 is about 1.2 times width 46.

What is claimed is:

1. A spinneret for the production of filaments of essentially round cross-section with at least seven continuous voids along the filaments, one void being centrally located, said spinneret comprising: a plate having upper and lower surfaces connected by a capillary, said capillary being defined at said lower surface by a plurality of segments equispaced a distance from and equispaced angularly about the center of the capillary, each of said segments being defined by an inner arcuate slot, connected to an outer arcuate slot by another elongated slot located between and in communication with said inner and said outer arcuate slots.

2. The spinneret as defined in claim 1, there being six of said segments.

3. The spinneret of claim 2 wherein said elongated slot connecting the inner and outer arcuate slots is rectangular in shape and has a width that is greater than the width of the inner arcuate slot and said outer arcuate slot has a width greater than the width of the slot connecting the inner and outer arcuate slots.

* * * * *